US005275204A

United States Patent [19]

Rogers et al.

[11] Patent Number: 5,275,204

[45] Date of Patent: Jan. 4, 1994

[54] VALVE ELEMENT

[75] Inventors: John T. Rogers, Plano; Frederick B. Pippert, Sugar Land, both of Tex.

[73] Assignee: Utex Industries, Inc., Houston, Tex.

[21] Appl. No.: 59,774

[22] Filed: May 10, 1993

[51] Int. Cl.[5] ..... F16K 15/06

[52] U.S. Cl. ..... 137/516.29; 137/533.25

[58] Field of Search ..... 137/516.27, 516.29, 137/533.21-

[56] References Cited

U.S. PATENT DOCUMENTS

| | | | |
|---|---|---|---|
| 664,146 | 12/1900 | Hackett . | |
| 2,233,649 | 3/1941 | Stahl et al. . | |
| 2,792,016 | 5/1957 | Shellman | 137/516.29 |
| 2,933,284 | 4/1960 | Yocum . | |
| 3,323,468 | 6/1967 | Thompson | 137/533.17 X |
| 3,331,582 | 7/1967 | Ford . | |
| 3,408,038 | 10/1968 | Scaramucci . | |
| 3,532,115 | 10/1970 | Hodil, Jr. . | |
| 4,345,738 | 8/1982 | Ripert . | |
| 4,518,329 | 5/1985 | Weaver . | |
| 4,643,221 | 2/1987 | Parker | 137/533.25 |
| 4,683,910 | 8/1987 | Benson . | |
| 4,860,995 | 8/1989 | Rogers . | |
| 5,062,452 | 11/1991 | Johnson | 137/533.25 |

*Primary Examiner*—Robert G. Nilson

*Attorney, Agent, or Firm*—Browning, Bushman, Anderson & Brookhart

[57] ABSTRACT

A valve element is disclosed comprised of a body section, upper guide, lower guide, sealing section and reinforcement section. The reinforcement section is made of materials having a hardness greater than the lower guide and sealing section. The reinforcement section, as well as the sealing section, have a frustoconical outer surface to increase support of the sealing section due to bracing from a mating valve seat annular sealing surface. The frustoconical outer surfaces of the valve element combine to form a uniform frustoconical surface. Two sealing sections may be disposed above and below the reinforcement section. These two sealing sections have frustoconical outer surfaces that cooperate with the frustoconical surface of the reinforcement section to form a continuous, co-extensive frustoconical outer surface.

20 Claims, 2 Drawing Sheets

FIG. 1
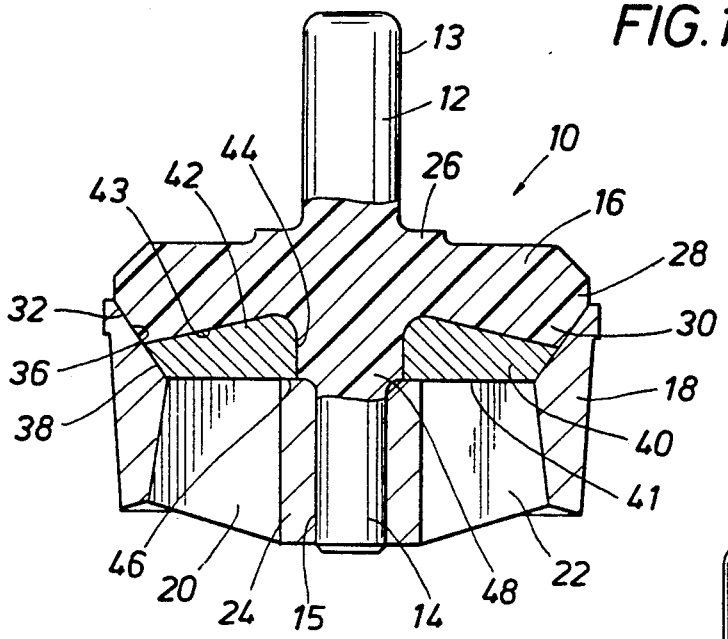
FIG. 3
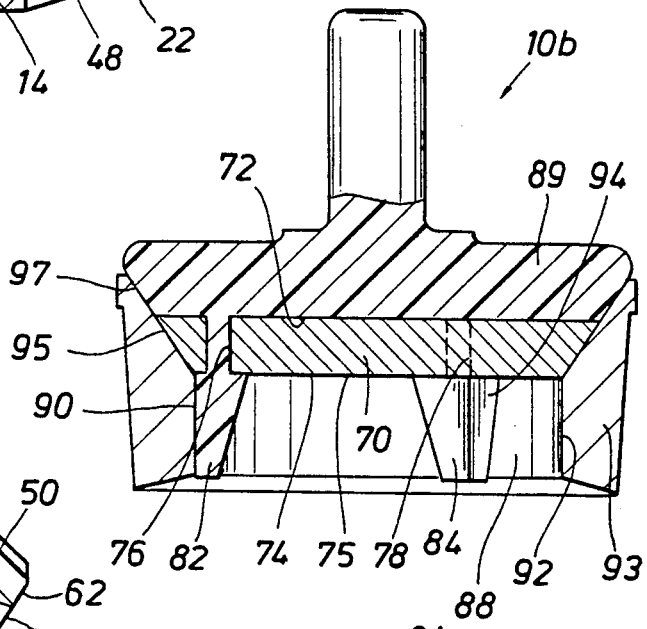
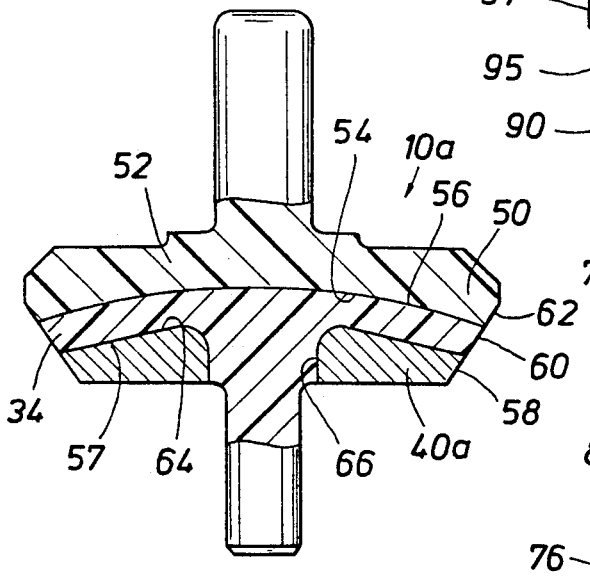
FIG. 2
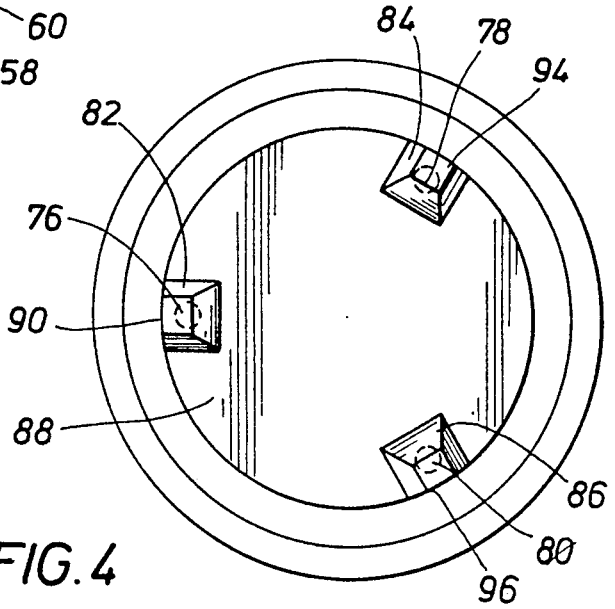
FIG. 4

FIG. 5
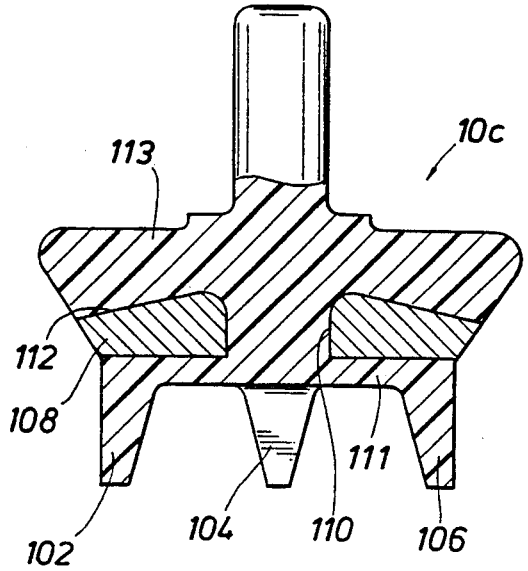
FIG. 7
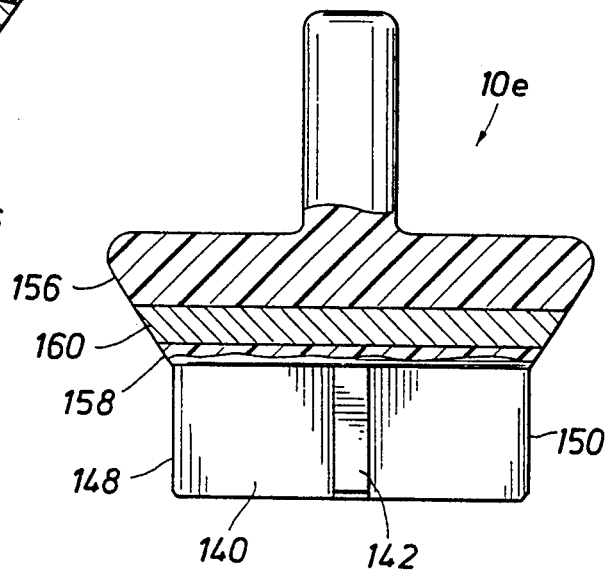
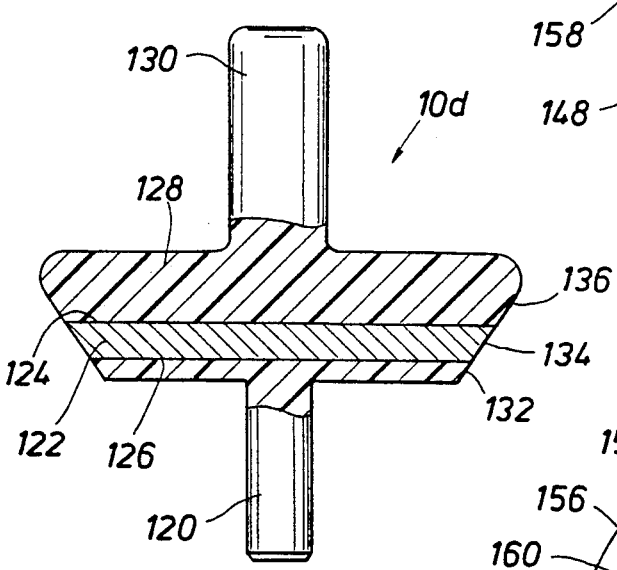
FIG. 6
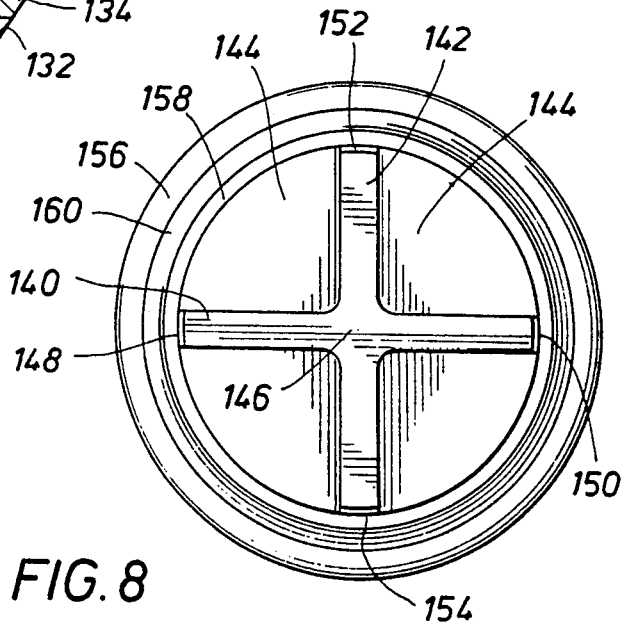
FIG. 8

VALVE ELEMENT

BACKGROUND OF THE INVENTION

1. Field of the Invention

The present invention relates to valve elements and, more particularly, to lightweight valve elements having reinforced sealing sections.

2. Description of the Background

Valve elements are found in many pumping mechanisms to control the direction of fluid flow through the pump. The valve element is typically biased to prevent fluid flow by sealing an annular valve seat during one portion of the pumping cycle. The valve element opens with respect to the valve seat to permit fluid flow during another portion of the pumping cycle.

Many deleterious forces act on the valve elements to cause a breakdown in the pump mechanism. For instance, in oil field mud and service pumps, valve elements may encounter reactive liquids at high pressures and temperatures. The liquids pumped in oil field applications include slurries containing various particulates and debris from the well bore that may damage the valve. Such liquids may have a wide range of viscosities. In some cases, highly caustic or acidic liquids may be pumped past the valve element that may score or damage parts of the valve element.

For this reason, most general service valve elements used in oil field pumps in the past have been comprised either substantially or completely of metal. However, the use of substantial amounts of metal in construction of the valve element used in such pumps results in a relatively heavy valve element. A heavy valve element produces a hammering effect each time it engages the valve seat. The excessive pounding of the valve element against the valve seat limits the lifetime of the valve element and the valve seat.

Lighter weight all-plastic valve elements, made of castable type resins of different hardness, have been used to make up the upper guide, body, and lower guide of the valve element (see for example U.S. Pat. No. 5,062,457). These valve elements suffer from the disadvantage that they must be made of compatible castable resins. Accordingly, such valve elements may suffer when the fluid media is not compatible with the castable resins used.

Consequently, there remains the need for an improved lightweight valve element that offers greater reliability and dependability of operation at reduced levels of capital investment.

SUMMARY OF THE INVENTION

Therefore, an object of the present invention is to provide a lightweight valve element that does not distort or extrude around the sealing surface during high pressure operation.

Another object of the present invention is to provide a lightweight valve element comprised of materials resistant to high temperatures and fluid media.

The valve element of the present invention includes a body portion having a first side and a second side and an annularly extending sealing section that defines a sealing surface. An upper guide is affixed to the first side of the body portion, which is formed of a substantially non-metallic material. A lower guide is affixed to the second side of the body portion. The lower guide is also formed of a substantially non-metallic material that may or may not be the same material as that of the upper guide or body portion. A reinforcement section is bonded to the sealing section. The reinforcement section is disposed proximate the lower guide relative to the sealing section. The reinforcement section is formed of a material that is harder than the material forming the sealing portion and the lower guide, i.e., it is of sufficient hardness to prevent any deleterious extrusion of the sealing section. The valve element is formed into an integral structure by bonding together of the upper guide, the body portion, the reinforcing section and the lower guide.

Other features and intended advantages of the invention will be more readily apparent by reference to the following detailed description in connection with the accompanying drawings.

BRIEF DESCRIPTION OF THE DRAWINGS

FIG. 1 is an elevational view, partially in section, of a valve element disposed on a valve seat in accord with the present invention.

FIG. 2 is an elevational view, partially in section, of a valve element in accord with the present invention having a convex supplemental brace section.

FIG. 3 is an elevational view, partially in section, of a valve element in accord with the present invention having a plurality of legs with outer surfaces forming a lower guide.

FIG. 4 is an elevational bottom view, partially in section, of the valve element of FIG. 3.

FIG. 5 is an elevational view, partially in section, of a valve element in accord with the present invention with three legs having outer surfaces that form a lower guide.

FIG. 6 is an elevational view, partially in section, of a valve element in accord with the present invention having a cylindrical lower guide and a continuous reinforcement section.

FIG. 7 is an elevational view, partially in section, of a valve element in accord with the present invention having intersecting planar sections forming a lower guide.

FIG. 8 is an elevational bottom view of the valve element of FIG. 7.

While the present invention will be described in connection with presently preferred embodiments, it will be understood that it is not intended to limit the invention to those embodiments. On the contrary, it is intended to cover all alterative, modifications, and equivalents included within the spirit of the invention and as defined in the appended claims.

DETAILED DESCRIPTION OF THE PREFERRED EMBODIMENTS

Lightweight valve element 10, in accord with a preferred embodiment of the present invention, is shown in FIG. 1. Valve element 10 includes an upper guide 12 and a lower guide 14. Cylindrical surfaces 13 and 15 of upper and lower guides, respectively, engage valve guide surfaces to help prevent wobble or tip off of valve element 10 as it reciprocates with respect to valve seat 18.

The terms "upper" and "lower" are used in this specification for the sake of convenience in describing the present invention with reference to the included drawings. The valve element may be positioned differently in operation with a pumping mechanism and may be reversed or tilted with respect to the position of the valve shown in FIG. 1. For the sake of definition and convenience then, valve body 16 will move in the general direction of the so-called upper guide 12 when opening to permit flow past valve element 10. Valve body 16 will move in the general direction of the so-called lower guide 14 when closing to prevent flow past valve element 10.

Valve element 10 opens and closes with respect to annular seating element 18 to respectively permit or prevent flow through fluid passageways 20 and 22. Annular seating element 18 includes tubular sleeve 24 in which lower guide 14 reciprocates to open and close valve 10 with respect to seating element 18. U.S. Pat. No. 4,860,995, which is incorporated herein by reference, discloses an exemplary valve member and more detail of the seating element and the general environment of a typical valve element.

Body 16 may include various annularly extending portions such as shoulder 26 and annular flange portion 28. Body 16 also includes an annular extending sealing section 30 that, as shown, defines a frustoconically shaped sealing surface 32. Annular extending sealing section 30 may be a continuous monolithic part of body 16, as shown in FIG. 1, or it may be comprised of a separate portion such as the separate section shown in FIG. 2, i.e., section 34, which is discussed hereinafter. Annular seating surface 32 engages seat 18 and mates with frustoconical seating surface 36 to seal and prevent flow through flow passages 20 and 22. Surfaces 32 and 36 may be disposed at approximately the same angle as shown but may also vary slightly or change at certain positions along the slope of frustoconical surface 36. The angle referred to is the angle the seating surface makes with an axis through valve element 12, which would be a vertical axis with respect to the valve position illustrated in Fig. 1. Avoidance of wobbling or tip off of valve element 10 with respect to annular seat seal 18 results in uniform engagement of the valve seat and valve element surfaces 32 and 36, respectively, as well as the frustoconical surface of reinforcement section 38.

As shown in FIG. 1, seating surface 36 also engages fustoconical support surface 38 of reinforcement section 40. Reinforcement section 40 is made of a material harder than that of sealing section 30 to prevent deformation or extrusion of sealing section 30. Other reinforcement sections shown in FIGS. 1-8 may be made of similar relatively hard materials. Materials used for reinforcement section 40, and other reinforcement sections illustrated, may include metals such as steel, brass and the like. As well, non-metallic substances may be used including various resinous or plastic materials such as, but not limited to, nylon, phenolics, acetals, polyacrylates, epoxides, polycarbonates, etc. These materials may be fortified with fibrous materials such as fiberglass, carbon fibers, aramids, polyesters, acrylics, and cotton. Combinations of these and other materials may also be used to form a reinforcement section such as reinforcement section 40. These materials are harder than the remainder of valve elements, such as valve element 10, to provide support for valve element 10 as a whole and, more particularly, sealing section 30. Other embodiments shown will use the same or similar materials in their corresponding components.

Typically, materials forming reinforcement section 40, or other reinforcement sections shown in FIGS. 1-8, may have a greater unit weight or specific gravity than the remainder of the valve element, especially in the case of metals such as brass. Because the reinforcement section comprises a fairly small percentage of the total volume of the valve element, the overall weight of valve element is kept to a minimum while sill providing a valve strength comparable to a steel valve in resisting damage caused by pumping at high pressures and high temperatures with high density slurries. Since the materials forming the reinforcement sections are harder, they generally but not necessarily, have greater tensile strength than materials used to form the remainder of the valve element such as valve element 10.

Components of preferred embodiment valve elements 10-10*d* shown in FIGS. 1-8 such as, for example, lower guide 14, upper guide 12, body 16 and sealing section 30 may be made of elastomeric or resinous type materials such as nitriles, neoprene, natural rubber, styrene-butadiene rubbers, fluoroelastomers, polyurethane, and other such materials or a combination of the same. Fibrous materials, as mentioned in connection with reinforcement section 40, may also be used. Since these materials are typically bonded together, for instance by adhesive bonding, they may be of a wide range of materials including those that resist reactive fluids, high pressures, high temperatures, and other harmful fluids encountered. Thus, these lightweight materials that form the greater part of valve element 10 may be used in combination with those of reinforcement section 40 to produce a lightweight general purpose valve element suitable for oil field applications and demands.

Support surface 38 of reinforcement section 40 is preferably frustoconical and mates with the corresponding portion of seating surface 36. The angle of frustoconical support surface 38 is preferably complementary to that of frustoconical seating surface 36 but may vary somewhat. Surfaces 32, 36, and support surface 38 have, in a preferred embodiment, substantially the same slope or angle. However, seating surface 36 may have two different slopes to mate with different slopes of sealing surface 32 and support surface 38, the latter two surfaces being contiguous and co-extensive with one another. For simplicity of manufacturing and sizing, a constant frustoconical seating surface 36 is preferably used to mate with the substantially continuous frustoconical surface formed by sealing surface 32 and support surface 38. For special purposes including increased sealing and/or increased support, multiple angles may be desirable.

The preferred frustoconical shape of support surface 38 has several functions. The frustoconical shape of support surface 38 mates to seating surface 36 to provide additional support of sealing surfaces 32 at the outer circumference of valve element 10. This outer support greatly enhances the strength of valve element 10 to resist deformation or extrusion at high pressures. Thus, the frustoconical support surface 38 acts as an anti-extrusion element to prevent extrusion or distortion of sealing surface 32 along seating surface 36 due to high pressure or high temperature operation. The frustoconical support surface 38 also acts as an additional sealing surface, albeit of harder material, to enhance sealing of valve element.

Furthermore, the frustoconical shape of support surface 38, which is effectively braced by mating frustoconical seating surface 36, allows a reduction in the thickness of reinforcing section 40 as it extends towards its outer circumference. This reduction in thickness is defined by a tapering surface 42 such that the thickness of reinforcing section 40 is preferably a minimum at its outer circumference. This reduction in thickness may be of greater importance when the materials forming reinforcement section 40 have a relatively high specific gravity or weight, such as when comprised of metal, so as to reduce the overall weight of valve element 10 without substantially reducing the support strength provided by reinforcement section 0. The arched or substantially concave surface 43 of sealing section 30 provides some additional structural support due to the arched shape. Another advantage of having tapering surface 42 is that it provides room for an increase in area of sealing surface 32. If reinforcement section 40 has a flat top as shown in FIG. 3, there may be less room along annular seating surface 36 for sealing surface 32. However, the length of annular seating surface 36 may be increased to accommodate for this as shown by annular seating surface 95 in FIG. 3.

The weight of reinforcement section 40 may be further reduced by providing an aperture defined by a generally cylindrical wall 44 of reinforcement section 40. Interior surface 46 of reinforcement section 40 abuts tubular sleeve 24 to brace the interior of valve element 10 against distortion. Thus, it is not necessary for reinforcement section 40 to extend across the entire cross-section of valve element 10. Bonding of reinforcement section 40 is also enhanced by increasing the surface area with additional bonding surfaces of column 48. Column 48 is preferably cylindrical but may assume other shapes corresponding to different aperture shapes defined by wall 44. For instance, column 48 and interior wall 44 could define a square shape. Also, interior wall 44 may have a larger or smaller diameter, depending on service conditions. Valve body 16 typically has a circular cross section with respect to column 48. Thus, column 48 is typically parallel to and may be concentric with a central axis through upper and lower guides 12 and 14. Surface 41 of reinforcement section 40 is exposed directly to fluids to be pumped. Thus, the material forming reinforcement section 40 may be chosen to be resistant to reactive fluids to be pumped.

FIG. 2 shows an alternative embodiment valve element 10*a* of the present invention. Supplemental brace section 34 is added to reinforcement section 40 to provide more support to sealing section of body 52. Thus, brace section 34 is preferably made of a material harder than sealing section 50 that, as shown in the embodiment of FIG. 2, is of the same material as body 52. Furthermore, both brace section 34 and sealing section 50 have an arched shape defined by upper convex brace surface 56 and lower seal section spherical or, in this case, more specifically concave surface 54. An arched structure provides additional strength to resist deformation of sealing section 50. As with valve element 10, reinforcement section 40*a* has a greater hardness, and may have a greater specific gravity or mass, than the remainder of valve element 10*a*. Lower side 57 of brace section 34 is substantially concave and is bonded with mating reinforcement section 40*a*.

The outer surfaces 62, 60, and 58, which mate to an annular seat such as sealing seat 18, are preferably frustoconical and preferably have the same angle or slope to effectively form a continuous, co-extensive frustoconical surface. It may be desirable, in some applications, that the slopes of the three surfaces vary from each other. While, in this embodiment, surface 62 is technically the sealing surface, all surfaces act to provide some sealing effect assuming they mate with a valve seat that has substantially the same slope. The advantages of frustoconical outer surfaces as discussed above in reference to valve element 10 apply equally to valve element 10*a*.

In some cases, it may be desirable that body 52 be made of a material harder than that of section 34. Thus, the sealing section in that case would theoretically be section 34 although effectively all surfaces 58, 60, and 62 may perform the function of sealing. In this case, section 34 would be supported on both its upper convex and lower concave sides 54 and 64. Section 34 may extend continuously across valve element 10*a* or have an aperture therethrough such as aperture 66 through reinforcement section 40*a*.

In FIG. 3 preferred embodiment of valve element 10*b* is illustrated. Reinforcement section 70 is substantially flat on both upper and lower sides 72 and 74. While reinforcement section 70 of 10*b* no longer has an aperture through its center portion as shown valve elements 10 and 10*a*, reinforcement section 70 is not completely continuous. Apertures 76, 78, and 80, shown also in FIG. 4, may extend entirely through reinforcement section 70, as shown, or may extend partially through reinforcement section 70. Legs 82, 84, and 86 may be bonded with reinforcement section 70 and body 89. Due to flat top surface 72 of reinforcement section 70, it may be desirable to increase to width of annular seat sealing surface 95 with respect to that of Fig. I to accommodate a larger sealing surface 97 of body 89.

Due to the shape of the lower guide of valve element 10*b* comprised of legs 82, 84, and 86 (seen also in FIG. 4), flow area 88 for valve element 10*b* may be larger than that for valve elements 10 and 10*a*. Outer surfaces on the three legs 90, 94, and 96, mate with surface 92 of annular valve seat 93 to help prevent wobble or tip off center as valve element 10*b* moves to close against annular valve seat 93. Thus, the closer the tolerances between these surfaces, the less wobble or tip off that may occur. Additional legs, for instance four or more legs, may also be used with this construction to prevent wobble without substantially decreasing flow area 88.

Surface 75 of reinforcement section 70 is exposed directly to fluids to be pumped. Thus, the material forming reinforcement section 70 may be chosen to be resistant to reactive fluids to be pumped. Another advantage of flat reinforcement section 70 is the need for less machining when reinforcement section is of metallic construction.

FIG. 5 illustrates an alternate preferred embodiment valve element 10*c*. Valve element 10*c*, like valve element 10*b*, has three legs 102, 104, and 106 to form a lower valve guide such as shown in FIG. 3. However, valve element 10*c* has several differences from valve element 10*b*. Reinforcement segment 108 includes an aperture defined by surface 1 1 0 and tapering surface 1 12. The value of such features have been discussed hereinbefore. Legs 102, 104, and 106 are bonded onto a lower portion 1 1 1 of body 1 1 3 rather than secured into apertures located in reinforcement section 108 as they may also be.

FIG. 6 discloses another preferred embodiment of the present invention in the form of valve element 10*d*. A cylindrical lower guide 120 is combined with a reinforcement section 122 having substantially horizontal upper and lower surfaces 124 and 126. As previously shown, surface 124 may be tapered. If desired, surface 126 may also be tapered, convex, or concave depending on the application. The desired taper and geometry affect the strength and weight of valve element 10*d*. For instance, arched curves may produce additional strength inherent in the geometry of the arch. Body 128 may be monolithic or be comprised of different layers of materials. Upper guide 130 may or may not be of the same material as body 128 and lower guide 120. Surfaces 132, 134, and 136 are preferably frustoconical and form a substantially uniform frustoconical surface. Effectively, in this embodiment, there may be two sealing surfaces 132 and 134 with a reinforcement support surface 134. Support surface 134 not only provides bracing and other advantages discussed hereinbefore but also provides at least some sealing.

FIG. 7 and FIG. 8 disclose yet another preferred embodiment of the present invention in the form of valve element 10*e*. Valve 10*e* includes planar members 140 and 142. Flow past valve element 10*e* occurs through four passageways such as passageways 144 that are open to flow when valve element 10*e* opens. Planar members 140 and 142 meet together at center 146 to form an X-shaped cross section. Thus, the positioning of planar member 140 and 142 support each other. Planar members 140 and 142 each have two outer guide surfaces shown as 148, 150 and 152,154, respectively. Guide surfaces 148, 150, 152, and 154 cooperate in the same manner discussed previously with respect to guide surfaces 90, 94, and 96 to maintain the orientation of valve element 10*e* constant with respect to a valve seat such as valve seat 93. That is, the guide surfaces act to prevent wobble or tip off center as it moves to the closed position to ensure sealing surfaces 156, 158 and support surface 160, will contact a corresponding annular valve seat uniformly around their periphery.

The foregoing disclosure and description of the invention is illustrative and explanatory thereof, and it will appreciated by those skilled in the art, that various changes in the size, shape and materials as well as in the details of the illustrated construction or combinations of features of the various valve elements may be made without departing from the spirit of the invention.

I claim:

1. A valve element for sealing with an annular valve seat, comprising:

a body portion having a first side, a second side and an annularly extending sealing section defining a sealing surface;

an upper guide secured to said first side of said body portion, said upper guide being formed of a substantially non-metallic material;

a lower guide secured to said second side of said body portion, said lower center guide being formed of a substantially non-metallic material;

an annularly extending reinforcing section secured to said sealing section, said reinforcing section being disposed proximate said lower guide relative to said sealing section, said reinforcement section being formed of a material that is harder than the material forming said sealing section and said lower guide, said valve element being formed into an integral structure by bonding together of said upper guide, said body portion, said reinforcing section and said lower guide.

2. The apparatus of claim 1, wherein said reinforcement section is formed of a material that is harder than said body portion and said upper guide.

3. The apparatus of claim 1, wherein said reinforcement section is formed of a substantially metallic material.

4. The apparatus of claim 1, wherein said sealing surface is frustoconical and said reinforcing section defines a frustoconical exterior surface.

5. The apparatus of claim 4, wherein a substantially continuous co-extensive frustoconical surface is formed from a combination of said frustoconical sealing surface and said frustoconical exterior surface of said reinforcing section.

6. The apparatus of claim 1, further comprising:

a columnar segment affixed to said body portion, said columnar segment being substantially perpendicular to a circular cross section of said body portion;

said reinforcing section having an aperture therethrough for receiving said columnar segment and being bonded thereto.

7. The apparatus of claim 1, wherein said reinforcing section has a tapering cross-sectional thickness, said tapering cross-sectional thickness decreasing to a minimum in the locus of said sealing surface of said annularly extending sealing section.

8. The apparatus of claim 1, wherein said body portion, said upper guide, and said lower guide comprise a monolithic segment of said valve element formed of substantially non-metallic material.

9. The apparatus of claim 1, wherein said reinforcing section is bonded to said sealing section and said body portion adjacent said lower guide.

10. The apparatus of claim 1, further comprising:

a supplemental brace segment within said reinforcing section, said supplemental brace segment having a first side and a second side, said first side of said supplemental brace segment being generally convex and mating with a convex body portion, said second side being substantially concave and mating with an annularly extending portion of said reinforcement section.

11. The apparatus of claim 10, further comprising:

frustoconical sealing surfaces on said sealing section, frustoconical outer surfaces on said supplemental brace segment, and frustoconical outer surfaces on said annularly extending portion of said reinforcement section.

12. The apparatus of claim 11, further comprising:

a substantially continuous frustoconical surface formed from the combination of said frustoconical sealing surfaces on said sealing section, said frustoconical outer surfaces on said supplemental brace segment, and said frustoconical outer surfaces.

13. The apparatus of claim 1, further comprising:

a substantially spherical surface on a side of said annularly extending sealing section.

14. The apparatus of claim 13, further comprising:

a substantially concave surface on said body portion mating with said substantially spherical surface of said annularly extending sealing section, said body portion having an exterior frustoconical surface mating with said annular valve seat, and a frustoconical portion of said sealing surface to mate with said annular valve seat.

15. The apparatus of claim 14, further comprising:

a substantially continuous, co-extensive frustoconical surface formed by a combination of said exterior frustoconical surface of said body section, said frustoconical portion of said sealing surface, and said frustoconical surface of said reinforcing section.

16. The apparatus of claim 1, further comprising:

a plurality of legs for said lower guide, each of said plurality of legs having an outer guide surface such that said outer guide surfaces cooperating with each other to maintain a constant orientation of said valve element with said valve seat.

17. The apparatus of claim 16, further comprising:

said reinforcing section having a plurality of mounting holes for receiving respective ones of said plurality of legs.

18. The apparatus of claim 1, further comprising:

two substantially planar members being joined at their respective centers to have a X-shaped cross-section, said two substantially planar members each having two guide surfaces to form a total of four guide surfaces such that said guide surfaces cooperate with each other to maintain a constant orientation of said valve element with said valve seat.

19. The apparatus of claim 1, further comprising:

a supplemental sealing section disposed on an opposite side of said reinforcing section from said annularly extending sealing section.

20. The apparatus of claim 19, further comprising:

a frustoconical portion on said sealing surface, a frustoconical exterior surface of said reinforcing section, and a frustoconical exterior surface of said supplemental sealing section.

* * * * *